US009345348B2

(12) United States Patent
Seiler et al.

(10) Patent No.: US 9,345,348 B2
(45) Date of Patent: May 24, 2016

(54) SERVING APPARATUS WITH FLANGE AND POUR CHANNEL

(71) Applicants: Ronald F. Seiler, N. Fort Myers, FL (US); Margo Gullickson, N. Fort Myers, FL (US)

(72) Inventors: Ronald F. Seiler, N. Fort Myers, FL (US); Margo Gullickson, N. Fort Myers, FL (US)

( * ) Notice: Subject to any disclaimer, the term of this patent is extended or adjusted under 35 U.S.C. 154(b) by 0 days.

(21) Appl. No.: 14/252,873

(22) Filed: Apr. 15, 2014

(65) Prior Publication Data

US 2015/0289688 A1 Oct. 15, 2015

(51) Int. Cl.

| | |
|---|---|
| ***B65D 5/72*** | (2006.01) |
| ***A47G 19/02*** | (2006.01) |
| ***A47G 19/12*** | (2006.01) |
| ***A47G 19/06*** | (2006.01) |

(52) U.S. Cl.

CPC ..... *A47G 19/02* (2013.01); *A47G 19/06* (2013.01); *A47G 19/12* (2013.01)

(58) Field of Classification Search

CPC ..... A47G 19/02; A47G 19/06; A47G 19/12
USPC ..... 222/566, 570, 572; 220/571, 571.1, 220/572, 573.1, 574.1, 700, 702, 719, 669, 220/695, 574, 694; 4/450
See application file for complete search history.

(56) References Cited

U.S. PATENT DOCUMENTS

| | | | | | |
|---|---|---|---|---|---|
| 967,638 | A * | 8/1910 | Hogan | 4/450 |
| 2,304,631 | A * | 12/1942 | Ensing | 4/450 |
| 2,611,903 | A * | 9/1952 | Wakeman | 4/450 |
| 4,957,224 | A * | 9/1990 | Kessler et al. | 222/465.1 |
| D371,714 | S * | 7/1996 | Lewis | D7/318 |
| 8,413,837 | B2 * | 4/2013 | Bollengier | 220/669 |
| 8,636,171 | B1 * | 1/2014 | Dattilo | 220/731 |
| 2005/0236443 | A1 * | 10/2005 | Gringer et al. | 222/570 |

* cited by examiner

*Primary Examiner* — Lien Ngo
(74) *Attorney, Agent, or Firm* — Katharyn E. Owen

(57) ABSTRACT

The present invention comprises serving apparatus which includes a bottom base which is a substantially planar closed surface for resting on a substantially horizontal surface. The apparatus also includes a substantially oval wall extending from the base having inside and outside surfaces that are smooth and uninterrupted between the base and an open top end. The apparatus also has a flange attached at the top end that extends horizontally inward and a pour channel positioned through the flange creating an aperture, wherein the pour channel, the flange, the outside surface of the wall and the inside surface of the wall form a smooth and uninterrupted surface. Furthermore, the flange causes a substance within the serving apparatus to fall back onto an object when the object is slid up the inside surface of the wall and contacts the flange.

16 Claims, 3 Drawing Sheets

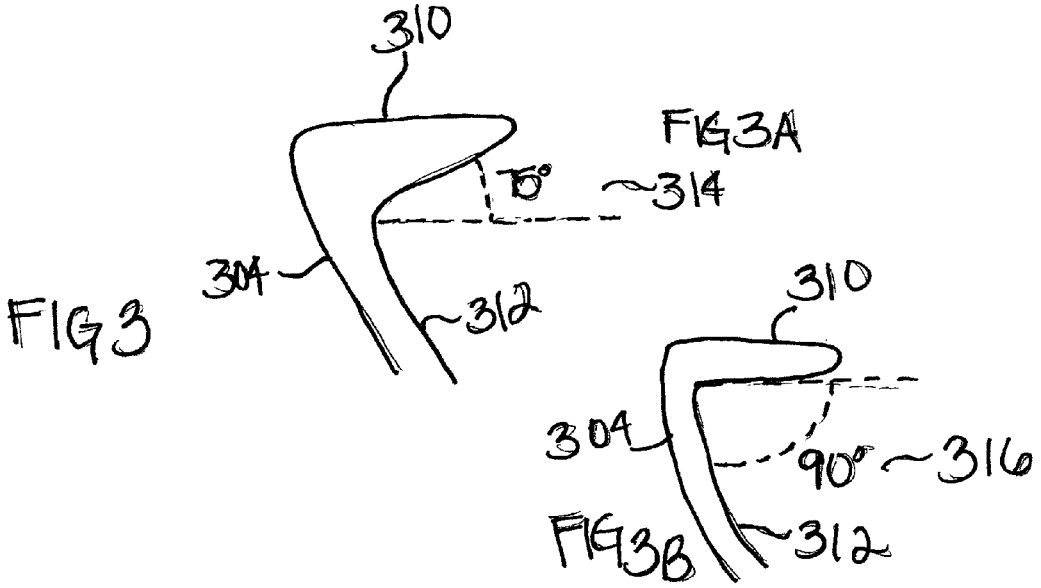
310
FIG3A
75°
314
304
312
FIG3
310
304
90°
316
FIG3B
312
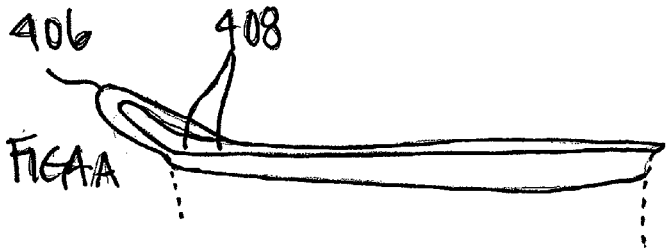
406
408
FIG4A
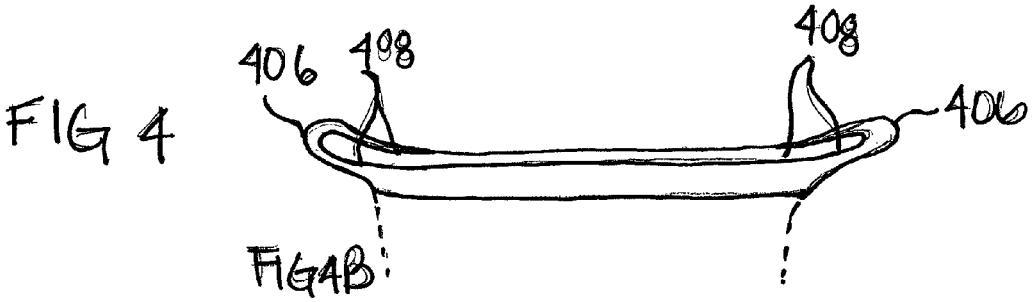
406
408
408
406
FIG 4
FIG4B

SERVING APPARATUS WITH FLANGE AND POUR CHANNEL

FIELD OF THE INVENTION

The present invention relates to easy to use serving apparatuses.

BACKGROUND OF THE INVENTION

Serving apparatus generally act to provide a container in which a user places edible substances, for example, cereal, soup and salsa. Serving apparatus, however, may be used in a number of fields and vary in shape and size. A typical apparatus can include a tray, a plate and a bowl.

SUMMARY OF THE INVENTION

It is, therefore, an object of the present invention to provide a serving apparatus. It is another object of the present invention to provide a method of using said serving apparatus.

An exemplary environment for the present invention can include, but is not limited to, while a person consumes a food product, for example, cereal or soup, and any other environment in which said serving apparatus in functionally necessary.

In an exemplary embodiment of the present invention, a serving apparatus can include a bottom base, a substantially oval wall, a flange and a pour channel.

In one exemplary aspect of this exemplary embodiment, a bottom base can be a substantially planar closed surface for resting on a substantially horizontal surface.

In another exemplary aspect of this exemplary embodiment, the substantially oval wall can extend from the base and have an inside surface and an outside surface.

In a further exemplary aspect of the substantially oval wall, the inside surface of the wall can be smooth and uninterrupted between the base and an open top end.

In yet still another exemplary aspect of this exemplary embodiment, the flange can be attached at the top end of the wall and can extend horizontally inward.

In one exemplary aspect of the flange, the outside surface of the wall and the inside surface of the wall can form a smooth and uninterrupted surface;

In yet a further exemplary aspect of this exemplary embodiment, the pour channel can be positioned through the flange creating an aperture.

In one exemplary aspect of the pour channel, the pour channel, the flange, the outside surface of the wall and the inside surface of the wall can form a smooth and uninterrupted surface.

In yet still another exemplary aspect of this exemplary embodiment, the flange can cause a substance within the serving apparatus to fall back onto an object when the object is slid up the inside surface of the wall and contacts the flange.

The following are additional and/or exemplary aspects of this exemplary embodiment, one or more of which can be combined with the basic invention as embodied above:

- the flange and the inside surface of the wall can meet at an at an angle in a range of 75° and 90° from the inside surface of the wall;
- the flange and the inside surface of the wall can meet at an 85° angle from the inside surface of the wall;
- the flange can extend horizontally inward for a distance such that when the object is slid up the inside surface the object can meet the flange and cannot slide up further than where it meets the flange;

- the pour channel can have a second flange which can extend substantially vertical from the outside edge of the pour channel, so as to inhibit unintentional discharge of the substance within the serving apparatus;
- the serving apparatus can comprise at least one material from the class of materials consisting of polyethylene, polypropylene, titanium dioxide, mineral filler, ceramic, glass, tin, aluminum, steel, cast iron and wood;
- the serving apparatus can be manufactured by injection molding; and
- the serving apparatus can be manufactured by casting and firing.

In another exemplary embodiment of the present invention, a serving apparatus can include a substantially round and open-top container.

In one exemplary aspect of this exemplary embodiment, the open top container can further comprise a flange attached at a top edge of the open-top container.

In an exemplary aspect of the flange, the flange can extend horizontally inward towards a center of the open-top container.

In one exemplary aspect of this exemplary embodiment, the open top container can further comprise a pour channel that can be positioned through the flange to create an aperture into the open-top container.

In one exemplary aspect of this exemplary embodiment, the flange can meet an inside surface of the open-top container at an angle within the range of 75° and 90°, which can cause a substance placed in the open-top container to fall back onto an object when the object is slid up the inside surface of the wall and contacts the flange.

The following are additional and/or exemplary aspects of this exemplary embodiment, one or more of which can be combined with the basic invention as embodied above:

- the flange and the inside surface of the wall can meet at an 85° angle from the inside surface of the wall;
- the flange can extend horizontally inward for a distance such that when the object is slid up the inside surface the object can meet the flange and cannot slide up further than where it meets the flange; and
- the pour channel can have a second flange which can extend substantially vertical from the outside edge of the pour channel, so as to inhibit unintentional discharge of the substance within the serving apparatus.

Additional exemplary embodiments include methods of using the serving apparatus as any of the exemplary embodiments. One exemplary method of using the serving apparatus can include the following steps alone or in any combining order, such as placing a substance into the interior of the serving apparatus.

In one aspect of this exemplary method, the serving apparatus can include a bottom base which can be a substantially planar closed surface; a substantially oval wall which can extend from the base and can have an inside surface and an outside surface, wherein the inside surface of the wall can be smooth and uninterrupted between the base and an open top end; a flange that can be attached at the top end of the wall and can extend horizontally inward, wherein the flange, the outside surface of the wall and the inside surface of the wall can form a smooth and uninterrupted surface; and a pour channel that can be positioned through the flange creating an aperture, wherein the pour channel, the flange, the outside surface of the wall and the inside surface of the wall can form a smooth and uninterrupted surface.

One exemplary step of the present exemplary method can include sliding the object up the inside surface of the wall, wherein the flange can cause a substance within the serving apparatus to fall back onto an object when the object is slid up the inside surface of the wall and contacts the flange.

Another exemplary step of the present exemplary method can include tilting the base of the serving apparatus so as to remove the object from the interior of the serving apparatus.

Yet still another exemplary step of the present exemplary method can include removing the object from the interior of the serving apparatus, wherein the object holds the substance formerly placed into the interior of the serving apparatus.

A further exemplary step of the present exemplary method can include tipping the serving apparatus so as to allow the substance to directionally discharge through the aperture created by the pour channel.

The following are additional and/or exemplary aspects of this exemplary method, one or more of which can be combined with the basic invention and method as embodied above:

- the flange and the inside surface of the wall can meet at an 85° angle from the inside surface of the wall;
- the flange can extends horizontally inward for a distance such that when the object is slid up the inside surface the object cam meet the flange and cannot slide up further than where it meets the flange; and
- the pour channel can have a second flange which can extend substantially vertical from the outside edge of the pour channel, so as to inhibit unintentional discharge of the substance within the serving apparatus.

These and other exemplary aspects of the present invention are described herein.

Those skilled in the art will recognize still other aspects of the present invention upon reading and understanding the attached description.

BRIEF DESCRIPTION OF THE DRAWINGS

The present invention is illustrated by way of example, and not in limitation, in the figures of the accompanying drawings.

FIG. 3 illustrates two exemplary angles of attachment of a flange to an interior wall of an exemplary serving apparatus. FIG. 3A depicts an attachment angle of 75°. FIG. 3B depicts an attachment angle of 90°.

FIG. 4 illustrates two exemplary configurations of a pour channel of an exemplary serving apparatus. FIG. 4A illustrates one pour channel. FIG. 4B illustrates two pour channels.

DETAILED DESCRIPTION OF THE INVENTION

The present invention will now be described in more detail by way of example with reference to the embodiments shown in the accompanying figures. It should be kept in mind that the following described embodiments are only presented by way of example and should not be construed as limiting the inventive concept to any particular physical configuration, material or order.

A serving apparatus, as described in more detail in this written description may be any serving device, for example, a bowl, a tray, a cup, plate, tin, or any other known and/or convenient device for serving or preparing an edible substance. Further embodiments of the serving apparatus as also contemplated for use with non-edible substances, for example, paint, oil, or any other non-edible substance for which a container having a flange and a pour channel would be desired.

Embodiments of the present invention, as illustratively shown in the figures, define a serving apparatus to minimize risk of and assist with containing a substance in a contained area so that it may easily be extracted from the contained area, without spilling or slipping off of the object used to remove the substance from the apparatus.

Figure 1:
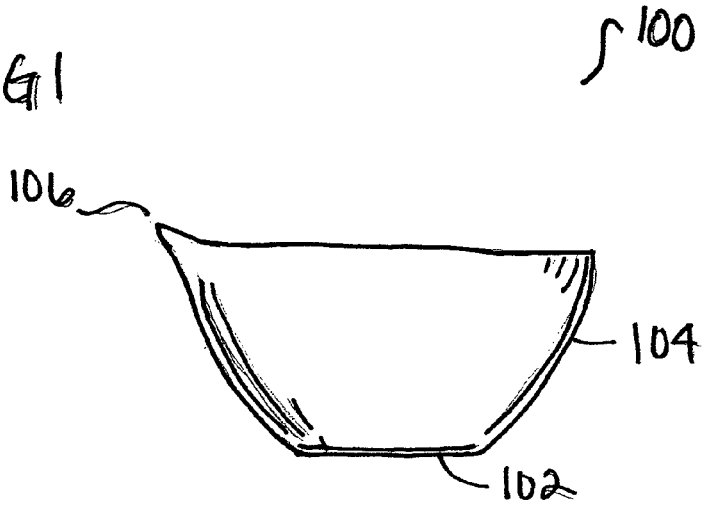
FIG. 1 illustrates an exemplary embodiment of the present invention, more specifically an exterior view of an exemplary serving apparatus.

FIG. 1 illustrates one exemplary embodiment of the present invention, more specifically an exterior view of an exemplary serving apparatus 100. Serving apparatus 100 may be formed of or include organic polymers, for example, polyethylene, polypropylene, titanium oxide, mineral filler, ceramic, glass, tin, aluminum, steel, cast iron, wood or any other known and/or convenient materials for serving or preparing edible substances. Furthermore, the materials may be treated and/or manufactured in such a way as to ensure that serving apparatus 100 can be heated and/or cooled with a substance placed in the interior of the apparatus 100. For example, serving apparatus 100 can be manufactured of a material which can be placed in a microwave, an toaster oven, a conventional or convection oven, a refrigerator, or a freezer.

As shown in FIG. 1, serving apparatus 100 has a bottom base 102 which is a substantially planar closed surface for resting on a substantially horizontal surface (not shown). Serving apparatus 100 may be cast, injection molded, carved, blown, or created through any known and/or convenient manufacturing method. It is further contemplated that the substantially planar surface of base 102 be able to rest on any number of available surface types, including but not limited to, for example, a table, a chair seat, a user's hand, or any other functionally compatible surface which may accommodate a substantially planar base 102.

Serving apparatus 100 also has a wall 104 extending from base 102. In FIG. 1, wall 104 is illustrated as being substantially oval, however wall 104 can be any functionally necessary dimensional shape, for example, round, square, rectangular, shallowly planar or any shape that is known and/or convenient for a serving apparatus. Furthermore, wall 104 may extend from the base at any suitable angle such as an angle in the range of 10° and 100° relative to the substantially planar base 102. In additional embodiments of the present invention, wall 104 does not extend from the base at a sharply defined angle, but instead is a gradual and/or curved transition from the base.

FIG. 1 further illustrates serving apparatus 100 having a pour channel 106 extending out from wall 104 and creating an aperture (not shown) into the interior surfaces of serving apparatus 100. Pour channel 106 is illustrated as extend from the a top edge side of wall 104, however, pour channel 106 may be formed on any portion of wall 104 which is functionally compatible with the purposes of creating an aperture through which a substance can directionally exit serving apparatus 100.

Figure 2:
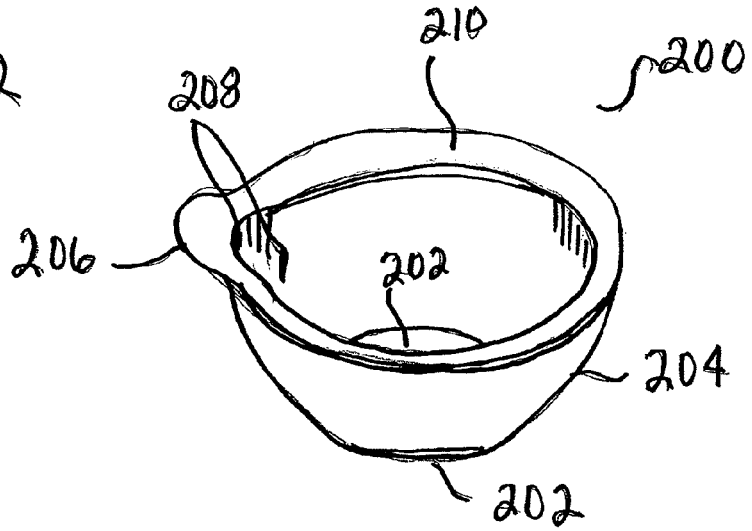
FIG. 2 illustrates an exemplary embodiment of the present invention, more specifically a perspective view of an exemplary serving apparatus depicting a flange and a pour channel.

FIG. 2 illustrates a perspective of a serving apparatus 200 which further depicts the interior and additional features of serving apparatus 200.

As shown in FIG. 2, serving apparatus 200 has a base 202 and wall 204, which are substantially the same as those described with reference to FIG. 1. Apparatus 200 also includes pour channel 206 extending from wall 204 and creating an aperture 208. Aperture 208 is illustrated in FIG. 2 as being a concave indentation into wall 204 which extends in a single surface from pour channel 206 to base 202. However, aperture 208 can have any functionally necessary configuration, including but not limited to, any inward formation from wall 202 which can create a surface which is conducive for allowing directional exiting of a substance placed into the interior of serving apparatus 200.

Additional embodiments of the present invention include a pour channel 206 which has a flange which extends vertically from the outer edge of pour channel 206. This flange is shaped in such a manner so as to inhibit unintentional discharge of the substance within the serving apparatus. Unintentional discharge of the substance, can occur, for example, where serving apparatus 200 is tipped or knocked over, or being carried by a user and held in a completely upright manner.

FIG. 2 further illustrates a top view of a flange 210, which is illustrated as being attached at the top end of the wall 204 and extends horizontally inward. Flange 210 creates a surface that is horizontally inward for a distance. The distance the flange extends inward can be any functionally compatible distance, for example, one-half inch, two-thirds inch, or one inch. It is contemplated in additional embodiments that the distance flange 210 extends inward is proportional to the overall size of serving apparatus 200. For example, where serving apparatus 200 has a substantially planar shape, such as a serving platter or chafing dish insert, which are commonly known to be larger serving items, flange 210 may extend between one and two inches out from wall 204. It is contemplated that in these configurations, pour spout 206 and aperture 208 are also proportionally sized so as to accommodate the scale of serving apparatus 200 and flange 210.

Flange 210 is configured in such a way that when an object, for example, a spoon, fork or chip, is slid up the inside surface the object can meet flange 210 and cannot slide up further than where it meets flange 210. The purpose of flange 210 may be to cause a substance within serving apparatus 210 to fall back onto the object when the object is slid up the inside surface of wall 204 and contacts flange 210.

Lastly, as illustrated in FIG. 2, flange 210, aperture 208, pour channel 206, wall 204 and base 202 can form a smooth and uninterrupted surface. Additional embodiments are contemplated, however, where each element as described herein can be fashioned as individual components which may be added and/or removed from serving apparatus 200. For example, pour channel 206 can be a detachable piece made from a separate material than wall 204. Additionally, flange 210 may be a "snap-on" piece which rests and becomes affixed to wall 204 through attachment elements. Any combination of material and removable elements are contemplated.

FIG. 3 illustrates two exemplary angles of attachment of a flange 310 to an interior portion 312 of wall 304. FIG. 3A depicts an attachment angle 314 of 75°. FIG. 3B depicts an attachment angle 316 of 90°. Flange 310 may be formed on any portion of wall 304 and attached to any location of interior portion 312. As described in reference to FIG. 2, flange 310 may be formed inwardly from wall 304 and/or interior portion 312, and may be formed with interior portion 312 at any angle to produce, for example, a curved surface from interior portion 312 to the innermost point of flange 310. Though only two angles of attachment 314 and 316 are illustrated, any angle may be used where it is functionally compatible for the purpose of limiting the departure of a substance from the interior of a serving apparatus. For example, the attachment angle range may be between 30° and 150°, 75° and 90°, or any other range which complies with standard manufacturing principles. In one exemplary embodiment of the present invention, the optimal attachment angle may be 85°.

FIG. 4 illustrates two exemplary configurations of a pour channel 406. FIG. 4A illustrates one pour channel 406 having one aperture 408. FIG. 4B illustrates two pour channels 406 having two apertures 408. Though FIG. 4 illustrates one pour channel 406 and two pour channels 406, any necessary quantity and configuration of pour channels 406 which comply with standard manufacturing principles or are functionally necessary for the type of substance to be contained within the serving apparatus may be used. For example, one embodiment of the present invention does not have a pour channel, whereas an additional embodiment of the present invention contemplates flange (not shown) and pour channel 406 to be manufactured in such a way so that the two elements are a single element and pour channel 406 extends the entire surface of the flange, essentially making the exit of a substance contained within the serving apparatus be multidirectional up to 180° in the x and y directions.

Figure 5:
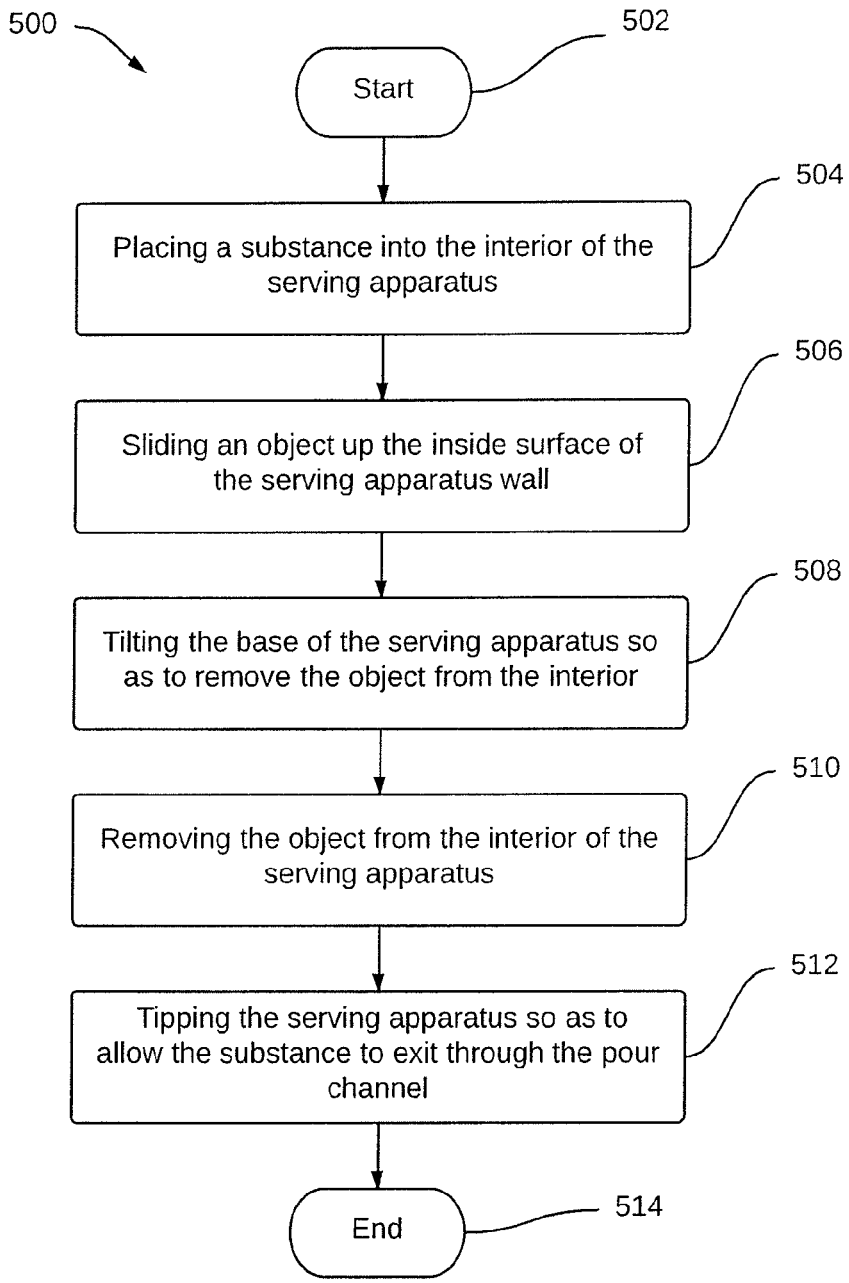
FIG. 5 illustrates a flowchart of an example method for using an exemplary serving apparatus.

FIG. 5 illustrates a flowchart of an example method for using an exemplary serving apparatus. The method is organized as a sequence of modules in flowchart 500. However, it should be understood that these and modules associated with other methods described herein may be reordered for parallel execution or into different sequences of modules. In the exemplary method illustrated in FIG. 5, the flowchart starts at 502 and the first step at 504 with placing a substance into the interior of the serving apparatus. In one example, the substance may be an edible substance, including but not limited to, cereal, soup, guacamole, salsa, dip and/or juice. Additional substances which are edible are also contemplated, for example, honey, oils, syrups, and sauces. Additional substances which are also contemplated, such as fragrant essential oils, potpourri, paints, and other substantially vicious substances.

In FIG. 5, flowchart 500 continues to module 506 where sliding of an object up the inside surface of the serving apparatus wall occurs. The sliding may be scraping, sliding, dragging or otherwise directing the object along the inside surface of the serving apparatus. In one contemplated example, edible substances such as cereal may build up along the side of the serving apparatus on the object while sliding. Objects are contemplated to include, but not be limited to, eating utensils such as fork, spoon and knife, as well as serving utensils such as tongs, ladles and serving spoons. It is further contemplated that the object may be another edible substance such as, for example, a chip, a cracker, a vegetable or other food item which is being dipped into the substance. In embodiments where the serving apparatus is being used for non-edible substances, it is contemplated that the object be a paint brush, a rag, a tool or any other functionally necessary object whose purpose would be to remove a substance from the interior of the serving apparatus.

In one example embodiment where elements of the serving apparatus are detachable (as described in more detail with reference to FIG. 1), a flange and pour spout may be detachably affixed to a container of cement. A user may drag cement up to the flange using a shovel.

The method illustrated in FIG. 5 continues at module 508 where the serving apparatus is tilted so that the object and substance may be removed. In order to facilitate the convenient and orderly withdrawal of the substance, after a user drags an object up the interior surface the flange is reached. The flange, for example, causes the substance to fall back on to the object that is being used to withdraw the substance. Tilting at 508 facilitates the withdrawal so that nothing is dropped and/or removed from the object.

In one example, if a user is withdrawing salsa using a tortilla chip, the salsa will fall back on to the tortilla chip when it reaches the flange and tilting the serving apparatus will assist the user by keeping the integrity of the tortilla chip in place (i.e., tilting will alleviate pressure of the chip and will not break the chip when it is removed).

The method illustrated in FIG. 5 continues at module 510 where the object is removed from the serving apparatus. Removing the object from the apparatus includes lifting, pulling, reshaping or otherwise directionally changing the location of the object. Removal at 510 is contemplated to be completed directly by a user, for example, a person using a spoon to eat soup from the serving apparatus. However, additional embodiments of the present method contemplate a user not directly removing the object from the apparatus, but instead using another object or apparatus to remove the object. For example, a person who does not have good controlling use of their hands may use a grabbing apparatus to remove the object. Also, where the substance is not an edible substance, for example, cement as described above, a robotic or machine-based apparatus may be used to remove an object like a trowel or shovel from the serving apparatus.

The method illustrated in FIG. 5 continues at module 512 with tipping the serving apparatus so as to allow the substance to directionally exit through the pour channel. For a number of substances that may be contemplated for containment in the serving apparatus, pouring the substance onto an object of other substance may be the optimal method of use. For example, where the serving apparatus contains honey or another vicious substance, pouring directly onto a biscuit or other item may be a better use of the serving apparatus than dipping the biscuit directly into the honey. An additional purpose of tipping the serving apparatus to allow for directional exit of the substance may include, for example, tipping directly into the mouth of the user to get the last drops of milk or pieces of food items contained in a soup or stew. Also, tipping to allow directional exit of a substance facilitates an easier method of cleaning the serving apparatus, as any remaining substance may be poured directly into a sink or waste disposal location such as a garbage can, so that a person or entity cleaning the serving apparatus need to come in contact with the substance.

Additional methods, aspects and elements of the present inventive concept are contemplated in use in conjunction with individually or in any combination thereof which will create a reasonably functioning serving apparatus. Methods of use are also contemplated using all optional aspects and embodiments as described above, individually or in combination thereof.

It will be apparent to one of ordinary skill in the art that the manner of making and using the claimed invention has been adequately disclosed in the above-written description of the exemplary embodiments and aspects. It should be understood, however, that the invention is not necessarily limited to the specific embodiments, aspects, arrangement and components shown and described above, but may be susceptible to numerous variations within the scope of the invention.

Moreover, particular exemplary features described herein in conjunction with specific embodiments and/or aspects of the present invention are to be construed as applicable to any embodiment described within, enabled thereby, or apparent wherefrom. Thus, the specification and drawings are to be regarded in a broad, illustrative, and enabling sense, rather than a restrictive one.

Further, it will be understood that the above description of the embodiments of the present invention are susceptible to various modifications, changes, and adaptations, and the same are intended to be comprehended within the meaning and range of equivalents of the appended claims.

We claim:

1. A serving apparatus, comprising:

a bottom base which is a substantially planar closed surface for resting on a substantially horizontal surface;

a substantially oval wall extending from the base having an inside surface and an outside surface, wherein the inside surface of the wall is smooth and uninterrupted between the base and an open top end;

a flange attached at the top end of the wall and extends horizontally inward, wherein the flange, the outside surface of the wall and the inside surface of the wall form a smooth and uninterrupted surface and wherein the flange and the inside surface of the wall meet at an angle in a range of 75° and 90° from the inside surface of the wall;

a pour channel positioned through the flange creating an aperture, wherein the pour channel, the flange, the outside surface of the wall and the inside surface of the wall form a smooth and uninterrupted surface; and wherein the flange causes a substance within the serving apparatus to fall back unto an object when the object is slid up the inside surface of the wall and contacts the flange.

2. The serving apparatus of claim 1, wherein the flange and the inside surface of the wall meet at an 85° angle from the inside surface of the wall.

3. The serving apparatus of claim 1, wherein the flange extends horizontally inward for a distance such that when the object is slide up the inside surface the object meets the flange and cannot slide up further than where it meets the flange.

4. The serving apparatus of claim 1, wherein the pour channel has a second flange which extends substantially vertical from the outside edge of the pour channel, so as to inhibit unintentional discharge of the substance within the serving apparatus.

5. The serving apparatus of claim 1, wherein the serving apparatus comprises at least one material from the class of materials consisting of polyethylene, polypropylene, titanium dioxide, mineral filler, ceramic, glass, tin, aluminum, steel, cast iron and wood.

6. The serving apparatus of claim 1, wherein the serving apparatus is manufactured by injection molding.

7. The serving apparatus of claim 1, wherein the serving apparatus is manufactured by casting and firing.

8. A serving apparatus comprising:

a substantially round and open-top container, and wherein a flange attached at a top end of the container and extending horizontally inward towards a center of the open-top container;

a pour channel positioned through the flange creating an aperture into the open-top container;

wherein the flange meets an inside surface of the open-top container at an angle within the range of 75° and 90° causing a substance placed in the open-top container to fall back onto an object when the object is slid up the inside surface of the wall and contacts the flange.

9. The serving apparatus of claim 8, wherein the flange and the inside surface of the wall meet at an 85° angle from the inside surface of the wall.

10. The serving apparatus of claim 8, wherein the flange extends horizontally inward for a distance such that when the object is slid up the inside surface the object meets the flange and cannot slide up further than where it meets the flange.

11. The serving apparatus of claim 8, wherein the pour channel has a second flange which extends substantially vertical from the outside edge of the pour channel, so as to inhibit unintentional discharge of the substance within the serving apparatus.

12. A method for using a serving apparatus, comprising:

placing a substance into the interior of the serving apparatus, the serving apparatus further comprising:

a bottom base which is a substantially planar closed surface for resting on a substantially horizontal surface;

a substantially oval wall extending from the base having an inside surface and an outside surface, wherein the inside surface of the wall is smooth and uninterrupted between the base and an open top end;

a flange attached at the top end of the wall and extends horizontally inward, wherein the flange, the outside surface of the wall and the inside surface of the wall form a smooth and uninterrupted surface and wherein the flange and the inside surface of the wall meet at an angle in a range of 75° and 90° from the inside surface of the wall; and a pour channel positioned through the flange creating an aperture, wherein the pour channel, the flange, the outside surface of the wall and the inside surface of the wall form a smooth and uninterrupted surface;

sliding the object up the inside surface of the wall, wherein the flange causes a substance within the serving apparatus to fall back onto an object when the object is slid up the inside surface of the wall and contacts the flange;

tilting the base of the serving apparatus so as to remove the object from the interior of the serving apparatus;

removing the object from the interior of the serving apparatus, wherein the object holds the substance formerly placed into the interior of the serving apparatus; and tipping the serving apparatus so as to allow the substance to directionally discharge through the aperture created by the pour channel.

13. The method of claim 12, wherein the flange and the inside surface of the wall meet at an 85° angle from the inside surface of the wall.

14. The method of claim 12, wherein the flange extends horizontally inward for a distance such that when the object is slid up the inside surface the object meets the flange and cannot slide up further than where it meets the flange.

15. The serving apparatus of claim 1, wherein the pour channel extends the entire surface of the flange, wherein an exit of a substance contained within the serving apparatus is multidirectional up to 180° in at least one of x and y directions.

16. The serving apparatus of claim 8, wherein the pour channel extends the entire surface of the flange, wherein an exit of a substance contained within the serving apparatus is multidirectional up to 180° in at least one of x and y directions.

* * * * *